United States Patent [19]

Tailleux et al.

[11] 4,411,195

[45] Oct. 25, 1983

[54] PRINTING PRESS WITHIN TEAR-LINE TRACING MEANS

[75] Inventors: Christian Tailleux, Ste-Anne des Plaines; Jacques Charbonneau, Brossard, both of Canada

[73] Assignee: Multidick Inc., Montreal, Canada

[21] Appl. No.: 338,898

[22] Filed: Jan. 12, 1982

[51] Int. Cl.[3] ..... B41F 13/56

[52] U.S. Cl. ..... 101/226; 83/863; 83/882; 83/884

[58] Field of Search ..... 101/226, 227, 224; 83/862, 863, 866, 867, 872, 879, 880, 881, 882, 883, 884, 886, 887

[56] References Cited

U.S. PATENT DOCUMENTS

| | | | |
|---|---|---|---|
| 565,186 | 8/1896 | Taylor | 83/863 X |
| 852,315 | 4/1907 | Burch | 83/879 |
| 852,375 | 4/1907 | Carlton | 83/879 |
| 1,235,293 | 7/1917 | Daven | 83/882 |
| 1,756,157 | 4/1930 | Jouret | 83/879 |
| 3,280,677 | 10/1966 | Grzymislawski | 83/881 |
| 3,577,636 | 5/1971 | DeTorre | 83/886 |
| 3,958,051 | 5/1976 | Smith | 83/862 |
| 4,068,582 | 1/1978 | Poitras et al. | 101/76 |
| 4,177,730 | 12/1979 | Schriber et al. | 101/226 |
| 4,291,824 | 9/1981 | DeTorre | 83/880 |

FOREIGN PATENT DOCUMENTS

| | | | |
|---|---|---|---|
| 664135 | 6/1963 | Canada | 83/863 |
| 577001 | 5/1933 | Fed. Rep. of Germany | 83/879 |
| 1203135 | 8/1970 | United Kingdom | 83/881 |

*Primary Examiner*—E. H. Eickholt

*Attorney, Agent, or Firm*—Robic, Robic & Associates

[57] ABSTRACT

A printing press including a printing section delivering printed sheets onto a conveying section at a receiving station, the conveying section incorporating a horizontally movable conveyor provided with grippers for grasping printed sheets discharged from the receiving station and moving them away. A rotary shaft is disposed transversely of and above the conveyor, onto which is provided a tear-line tracer assembly which projects radially and lengthwise of the shaft. This assembly includes a tracer blade having an elongated serrated straight cutting edge extending parallel to the axis of rotation of the shaft and being adapted to produce tear-lines when applied over and across the printed sheets when the latter are moved by the conveyor. A rotary support roll is provided beneath the conveyor and over the top of which printed sheets bear as they are moved by the conveyor. The axes of rotation of the shaft and of the support roll lie in a common vertical plane and the cutting edge of the blade as the tear-line assembly is adjustable, when lying in the aforesaid vertical plane, with respect to the top of the support roll to ensure production of the tear-lines and the printed sheet material when the latter moves therebetween.

12 Claims, 4 Drawing Figures

PRINTING PRESS WITHIN TEAR-LINE TRACING MEANS

The present invention relates to a printing press, particularly of the offset type, to which is incorporated a novel means for tracing tear-lines on sheet material printed by the printing press.

A printing press to which the present invention relates generally includes a printing section which print sheet material such as sundry bills, cheques or the like forms used particularly in commerce and industry and hereinafter referred to simply as printed sheets. These printed sheets are delivered from the printing section into a receiving station leading the printed sheets onto a conveying section which incorporates a horizontally movable conveyor provided with grippers grasping the printed sheets discharged from the receiving station and moving them to the other end of the conveyor to drop them into a collecting tray. Such a press is also provided with a machine for numbering the printed sheets during their travel on the conveyor. The aforesaid arrangement is of the type disclosed in our prior U.S. Pat. No. 4,068,582 of Jan. 17, 1978 and its corresponding Canadian Pat. No. 1,068,157 of Dec. 18th, 1979.

However, there is often need for such printed sheets to be provided with tear-lines, either longitudinally or transversely, in order to ease and afford separation of various sections of the printed sheets. To our knowledge, there is not presently available any printing press of the above general type which is designed to produce such tear-lines. In consequence, when the printed sheets come out of the printing press, they have to be processed through a different machine designed especially to produce tear-lines. Furthermore, if tear-lines at right angles to one another are required on the same printed sheet, the sheets have to be processed twice through the machine. This additional machine and step of course result in an increased cost of the printed sheets.

It is therefore an object of the present invention to avoid the aforesaid disadvantage by providing a printing press which is especially designed additionally to allow the production of tear-lines, transversely and/or longitudinally of the sheets, whenever required.

More specifically, the invention essentially lies in the provision of a printing press including a printing section delivering printed sheets onto a conveying section at a receiving station of the conveying section, the latter incorporating a horizontally movable conveyor provided with means for gripping the printed sheets discharged from the receiving station and moving them away from the receiving station. This printing press is characterized by the provision of means for producing tear-lines on the printed sheets, such means comprising: a rotary shaft disposed transversely of and above the conveyor, adjacent to and downstream of the receiving station, this shaft having a tear-like tracer assembly projecting radially and lengthwise thereof, which tracer assembly includes a tracer blade having an elongated serrated straight cutting edge extending parallel to the shaft rotation axis, the serrated cutting edge being adapted to produce tear-lines when applied over and across the printed sheets as the latter are moved by the conveyor, and a rotary support roll beneath the conveyor and over the top of which the printed sheets bear as they are moved by the conveyor. The axes of rotation of the shaft and of the support roll lie in a common vertical plane and means are provided in the said tear-line assembly to adjust the cutting edge of the blade, when it lies in the vertical plane, with respect to the top of the support roll to ensure proper production of the tear-lines on the printed sheet material when the latter moves therebetween. Means are of course provided to synchronize the rotation of the rotary shaft and support roll with the movement of the conveyor to produce the tear-lines at a selected location on the printed sheets.

Advantageously, the means for producing tear-lines may further include a second tracer assembly on the rotary shaft, this second tracer assembly comprising a second tracer blade having an elongated straight serrated cutting edge extending parallel to the shaft rotation axis and being adapted likewise to produce tear-lines when applied over and across the printed sheets. Means are also provided adjustably to mount the second blade on the shaft to position it at a selected angle with respect to the blade of the first tear-line tracer assembly. This second tracer assembly affords of course the production of two parallel transverse tear-lines on every printed sheet, whenever such are called for.

The printing press of the invention involves a press roll in the printing section adjacent the receiving station, this press roll directing the printed sheets toward the receiving station and being rotatable about an axis which is parallel to the axes of rotation of the shaft and of the support roll. In a further preferred embodiment of the invention, the means for producing tear-lines includes a third tracer assembly suitable to produce tear-lines extending longitudinally of the printed sheets and comprising: a mandrel mounted parallel to the surface of the press roll and adjacent thereto; at least one circular rotary tracer disk mounted radially and at a selected location on the mandrel, this tracer disk having a circular serrated cutting edge adapted to produce tear-lines when applied over the printed sheets, and means biassing the mandrel toward the press roll to apply the tracer disk against the printed sheets as the latter are directed toward receiving station by the press roll.

The description of a preferred embodiment of the invention now follows having reference to the appended drawing wherein.

Figure 1:
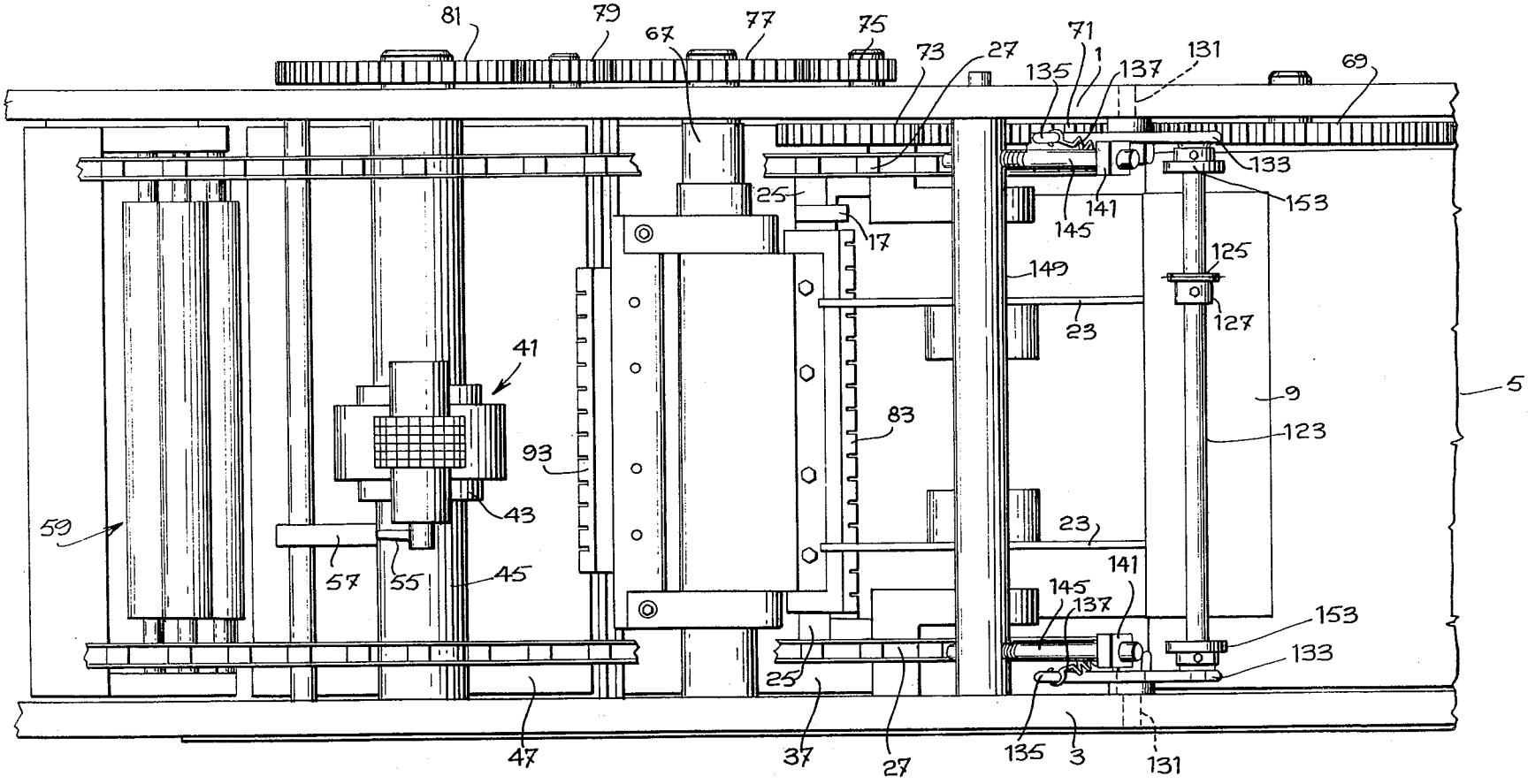
FIG. 1 is a top plan view of a printing press incorporating the tear-line producing means of the invention.
Figures 2, 2A:
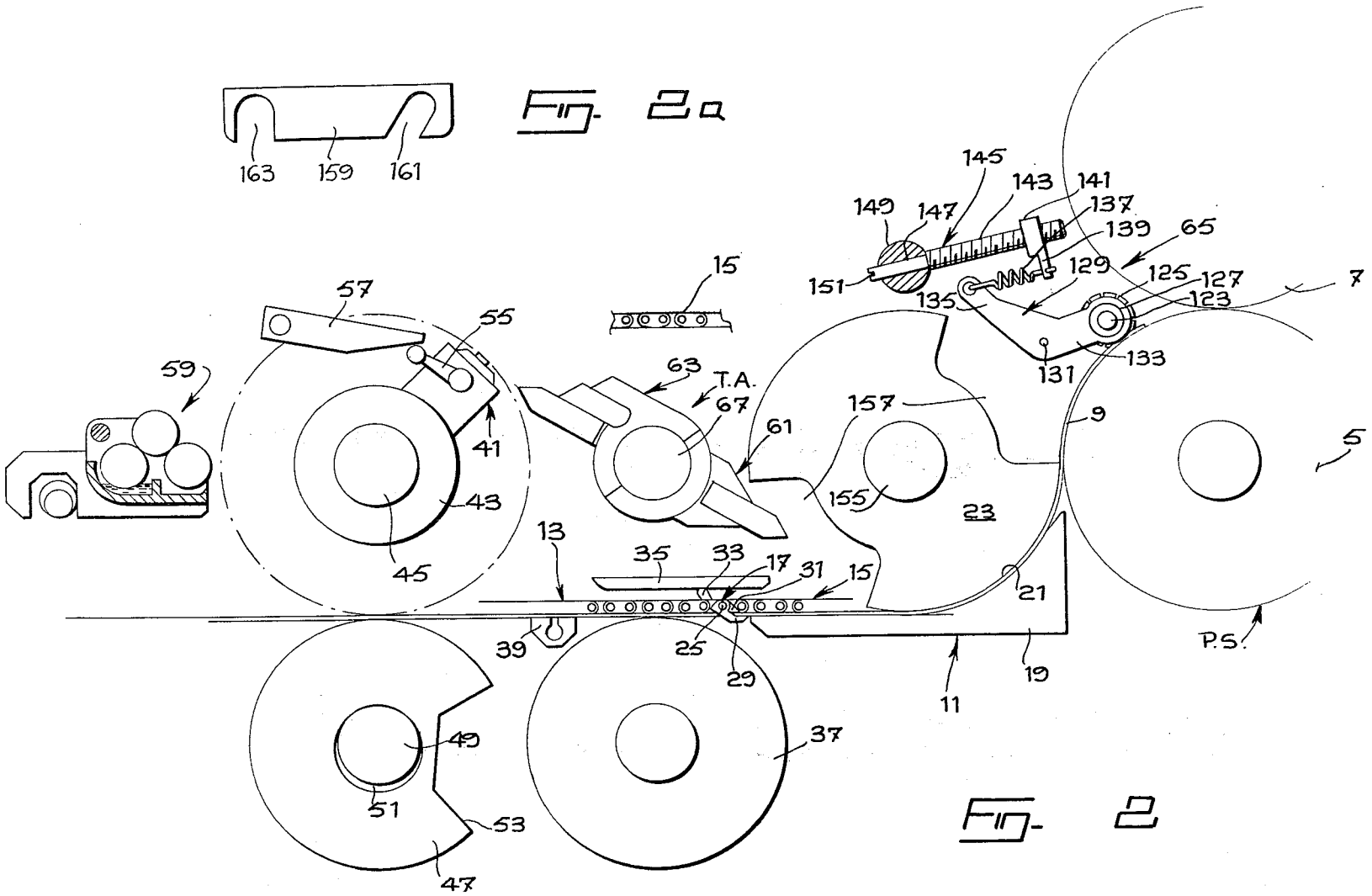
FIG. 2 is a schematic side elevational view of the main components of the printing press of FIG. 1.

Referring now more particularly to FIGS. 1 and 2, the printing press is shown in its essential parts which are mounted between two upright sidewalls 1, 3 of the frame of the press, part of the gear driving and synchronizing system being however located outwardly of wall 1, as best seen in FIG. 1.

Printing section P.S. of the press is simply represented by a pair of superposed press rolls 5, 7. A printed sheet 9 is illustrated as being discharged into the receiving station 11 of a conveying section 13 which incorporates a horizontally movable chain conveyor 15 provided with known means 17 for gripping the adjacent leading edge of the sheets 9 to move them away successively from the receiving station 11 toward the other end of the conveyor 15 where they are discharged in a collecting tray, not shown.

The receiving station 11 is made up of a base 19, having an upwardly curving sheet guiding top surface 21 tangent to the surface of the roll 5, and of a pair of rotary disks 23 cooperating with the surface 21 to press therebetween and thus drive the sheets 9 beneath the conveyor 15 and into a gripping device 17, there being a series of such gripping devices 17 spacedly provided along the conveyor 15, as part thereof. Such gripping devices ae known and it may be sufficient to indicate that each is formed of a series of grippers mounted on a transverse rod 25 of which the ends are secured to the chains 27 (FIG. 1) of the conveyor 15, which chains are located adjacent to the sidewalls 1, 3. Each gripper in turn comprises a pair of jaws 29, 31, normally biassed toward one another by a spring (not shown), the lower jaw 29 being secured to the rod 25 while the jaw 31 is rotatably mounted thereon and operable by a cam follower 33, reacting against the lower surface of a cam 35, to pivot the jaw 31 away from the jaw 29 and keep the gripper open until past the downstream end of the cam 35 at which time the cam follower 33 is released and the jaw 31 spring biassed toward the jaw 29 with the leading edge of a sheet 9 therebetween, the sheet 9 having been driven into the grippers by the drive action of the base 19 and of the disks 23.

The thus printed sheet 9 then moves over the top surface of a rotary support roll 37, located beneath the conveyor 15, which cooperates with novel rotary tracer assemblies T.A., disposed above the conveyor 15 to produce tear-lines across the printed sheet 9 as will be further described hereinafter.

It will be noted that immediately downstream of the top of the support roll 37 and past the end of the cam 35 where the grippers 17 grasp the leading edge of the sheet 9, there is provided a device 39 adapted to produce a vacuum keeping the printed sheet 9 taut between the gripping device 17 and the said vacuum device 39. The use of the latter is preferable for the number-printing procedure that is to follow since at that time the lagging edge of the printed sheet 9 will have left the receiving station 11 and consequently no longer pressed by the disks 23 and base surface 21.

Downstream of the tear-line producing station, aforesaid, is a numbering station in which numbers are provided on the successive printed sheets. There is, for this purpose, provided a numbering machine 41 having a drum 43 fixed to a rotary shaft 45 and an impression roll 47 cooperating with the machine 41 to print the said numbers. The roll 47 is mounted on a rotary shaft 49 and is actuated, in known manner, by an eccentric system 51 associated with the shaft 49, the purpose being to lift the roll 47 slightly upwardly and press it against the numbering machine 41 in synchronism with the passage of each printed sheet whereby to obtain a proper impression.

As will be noted, the impression roller 47 is suitably notched at 53 to allow the passage of the rods 25 on which the grippers 17 are mounted, it being thus understood that the peripheral length of the impression roll 47 between the ends of the notch 53 is generally equal to the length of a sheet 9 of printed material.

The numbering machine 41 is of a conventional type including a well-known arrangement of printing wheels having serial numbers thereon which are selectively advanced in a known manner by means of a pawl each time a number is to be impressed upon a sheet 9. Advancement of the printing wheels takes place under the control of an arm 57 which can be selectively positioned in the path of a pawl 55 to cam the latter at each revolution of the drum 43.

A likewise conventional removable inking device 59, including a plurality of rollers, is positioned in cooperative relationship with the numbering machine 41 so as to contact and to ink it either automatically at each revolution or manually at selected moment, in known manner.

Except of course for the presence of the tear-lines assemblies T.A., the aforedescribed machine is known and further details thereon are disclosed in our aforesaid U.S. and Canadian patents.

As will be more fully explained hereinafter, the press rolls 5, 7, the disks 23, the support roll 37, the tracer assemblies T.A., the numbering machine 41 and the impression roll 47 are driven in synchronism with the conveyor 15 so that their linear peripheral speed be equal to the linear speed of the conveyor 15. With this in mind, the general operation of the machine will now be briefly described.

The printed sheet 9 moves from the press roll 5 into the space between the disks 23 and the base 19 to be driven thereby. As the leading edge of a sheet 9 reaches past the downstream end of the base 19, it is received in the open jaws of the grippers 17. The pushing action of the disks 23 and the base 19 causes further advancement of the sheet 9 which thus moves over the roll 37 at which time a tear-line is drawn by a tear-line tracer assembly T.A. which also has the effect of ensuring that the leading edge is properly nested in the space between the jaws 29 and 31 of the grippers 17. The conveyor chains 27 then move the grippers 17 beyond the cam 35 thereby freeing the cam follower 33 permitting closing of the jaws 29, 31 over the leading edge of the sheet 9. After the grippers have moved downstream further and pas the vacuum producing device 39, the latter ensures tautness of the sheet which is then in an adequate condition to receive the numbers from the numbering device 41.

The description now follows of the novel means for prosducing tear-lines which means take the form of a first and second tear-line tracer assemblies 61, 63 (referred to hereinabove by the letters T.A.) and a third tracer assembly 65, all of which appear in FIGS. 1 and 2, FIG. 3 being limited to tracer assemblies 61 and 63.

Figure 3:
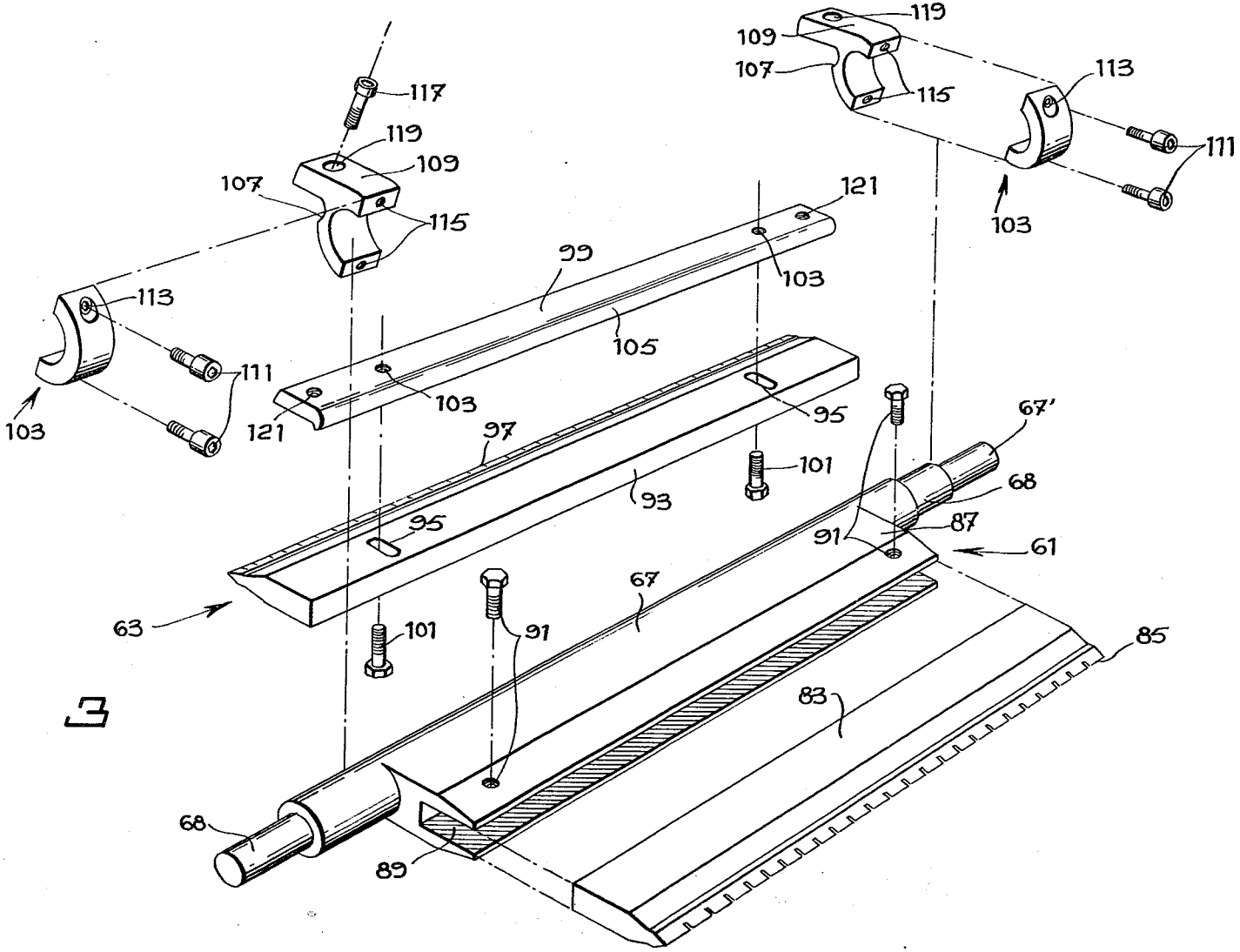
FIG. 3 is an exploded perspective view of the first and second tear-line tracer assembly.

As best shown in FIG. 3, the tracer assembly 61 is integral with a rotary shaft 67 extending across the space between the sidewalls 1 and 3 and being rotatably mounted thereon. The axis of the shaft 67 is parallel to and lies in the same vertical plane as the axis of rotation of the support roll 37, this situation being clearly illustrated in FIG. 2. The shaft 67 is journalled at 68 (FIG. 3) in the frame walls 1 and 3 of the machine in any known manner, having one end extending past sidewall 1 into a stub shaft 67' on which a driving gear 77 is removably secured.

As appears clearly from FIGS. 2 and 3, the first tracer line assembly 61 projects radially and lengthwise of the shaft 67. It includes a tracer blade 83 having an elongated serrated straight cutting edge 85 extending parallel to the rotation axis of the shaft 67, the edge 85 thus defining spaced teeth suitable to produce tear-lines when pressed on and across the printed sheets 9 when the latter pass over the top of the support roll 37.

The tracer assembly 61 comprises a blade holder 87 formed with an outwardly open U-shaped housing 89 into which the tracer blade 83 is slidably received to be fixed therein by screw means 91. Thus, the housing 89 and screw means 91 constitute means to adjust the position of the cutting edge 85 with respect to the top of the metal support roll to ensure production of tear-lines on the printed sheets 9. More specifically, the adjustment is obtained by rotating the assembly 61 so that the cutting edge 85 lies in the aforesaid vertical plane of the axes of the shaft 67 and support roll 37 when no sheet material lies therebetween. The screws of the screw means 91 are then loosened to release the blade 83 and allow it freely to fall over the top of roll 37, by mere gravity. The screws are thereafter fastened to clamp blade 83 into that position.

The second tracer assembly 63 also projects generally radially and lengthwise of the rotary shaft 67. It comprises a second longitudinal and elongated tracer blade 93 provided with transversely elongated fastening slots 95. Otherwise, blade 93 is like blade 83 in configuration, having a straight serrated cutting edge 97. The assembly 63 also includes means for adjustably mounting it on shaft 67 to position the second blade 93 at a selected angle with respect to the blade 83 of the first assembly 61. It will thus be appreciated that assembly 61 and 63 may be used to produce two tear-lines on one printed sheet, the distance between them being of course equal to the linear distance along the circular arc separating the cutting edges 85 and 97.

The adjustable mounting means aforesaid for the blade 93 are illustrated in the form of a holding plate 99 to which the blade 93 is secured by means of screws 101 extending through the elongated slots 95 and threaded into tapped holes 103 of the plate 99; the combination blade 93, plate 99 cooperating with two-part collars 103 which releasably and adjustably mount it on the shaft 67 on either side of the blade holder 87 of the first assembly 61.

For this purpose, the holding plate 99 extends beyond the ends of the blade 93 and is formed with a rounded flanged side edge 105, the rounded flange of the extended ends being nested into a likewise rounded groove 107 of one part of each collar 103. The grooves 107 lie beneath and at the inner ends of holding fingers 109 that project away from the shaft 67 when the collars 103 are fixed thereto by means of screws 111 extending freely through holes 113 of the other collar parts of the collars 103 to be threaded into corresponding tapped holes 115 of the fingered collar parts. The holding plate 99 is secured beneath the fingers 109 by nuts 117 slidable through holes 119 and threaded into tapped holes 121 at the extended ends of the holding plate 99.

It will be gathered from the above description that the second tracer assembly 63 can easily be adjusted angularly with respect to the first assembly 61 simply by loosening the screws 111, rotating the assembly to the desired position and thereafter re-fastening the screws 111. The adjustment of the cutting edge 97 of the blade 93 is obtained in the same manner as has been described in relation to the blade 83 of the first assembly 61.

It will also be realized that when the tracer assemblies 61, 63 are not needed, their respective blades 83 and 93 may simply be slid away toward the rotary shaft 67.

Since, in a printing press of conventional design, the space is quite cramped between the main components (the disks 23, the numbering assembly including machine 41 and the rolls 47 and 37,) it will be necessary to provide adequately disposed spaced cut outs 157 in the disks 23 to allow unobstructed passage of the blades of the first and second tracer assemblies 61 and 63.

The third tear-line tracer assembly 65 is shown in FIGS. 1 and 2 as comprising a mandrel 123 mounted parallel to the press roll 5 and somewhat adjacent to its surface. A circular tracer disk 125 having a hub 127 is releasably secured to it, in any known manner, at a selected position on the mandrel 123 which corresponds to the position where a longitudinal continuous tear-line is desired on the printing sheet 9. Additional tracer disks are of course provided where more than one tear-line is needed. The said tracer disk 125 has, similarly to blades 83 and 93, a serrated cutting edge which is of course circular and which is suitable to produce longitudinal tear-lines when applied over the printed sheets 9. The third assembly further includes means biassing the mandrel 123 toward the press roll 5 whereby to apply the tracer disk 125 against successive printed sheets 9.

The illustrated biassing means according to this described embodiment comprises a pair of bell-crank levers 129 respectively mounted on the sidewalls 1, 3 by means of pins 131, integrally or otherwise secured at the lever apices, the pins 131 being further journalled across the sidewalls 1, 3 to allow free pivotal movement of the bell-crank levers 129 about a common axis which is parallel to that of the mandrel 123; the latter mandrel being mounted in turn and at its free ends, in any known manner, for free rotation on the respective ends of one arm 133 of the levers 129. An adjustable bias is applied to the respective ends of the other arms 135 of the levers 129 to rotate them so as to cause application of the tracer disk 125 onto the printed sheet 9. This adjustable bias is obtained, in the case of each lever 129, by means of a coil spring 137 having one end fixed to the free end of the lever arm 135 and the other end to the outer end of a finger 139 projecting laterally from a control nut 141 which is screwed onto the threaded portion 143 of a rod 145 having an unthreaded end 147 slid across a transverse diametral hole of a spindle 149 fixed, at either end, to the sidewalls 1 and 3. The unthreaded end 147 has a screw-drive slot 151, as shown. In this manner, as will easily be understood from perusal of FIGS. 1 and 3, clockwise rotation of the control rod 145 will move the nuts 141 away from the spindle 149, causing bell-crank levers 129 to be biassed counterclockwise through the tension bias applied to the springs 137, thereby pressing the tracer disk 125 against the passing printed sheet 9. Reverse rotation of the control rod 145 will of course produce release of the pressure applied by the tracer disk 125.

A pair of safety support rollers 153 are secured each at one end of the rotary mandrel 123 (FIG. 1), being adapted to bear on press roll 5. The diameter of the rollers 153 is selected so as to be sufficient to allow the production of an adequate longitudinal tear-line on the printed sheets 9 but sufficient also to prevent undue damage to the peripheral metal surface of the press roll 5 by the tracer disk 125 should an excessive bias be inadvertently applied by the aforesaid biassing means.

As mentioned above, the printing press of the invention comprises means synchronizing the motion of the rotary shaft 67 and the support roll 37 with the movement of the conveyor 15 to produce transverse tear-lines on the printed sheets 9 at a selected location or locations thereon. The synchronizing means shown in the disclosed embodiment is of conventional type and may be generally described as follows.

Power is applied first to a driving gear (not shown) which is that of the top press roll 7, which driving gear meshes with a gear 69 (FIG. 1) driving the lower press roll 5, the gear 69 meshing in turn with a gear 71 (FIGS. 1, 4) fixed on a transverse shaft 155 (FIG. 2), journalled on the sidewalls 1, 3 and onto which the disks 23 are mounted for rotation.

Also mounted on the shaft 155 are two sprocket wheels (not shown) driving the chains 27 of the conveyor 15. Two further sprocket wheels (not shown) are mounted at the other end of the conveying section, acting as driven wheels for the chains 27. There are also provided guiding sprocket wheels (not shown) whenever required along the top and bottom strands of the conveyor chains 27.

The gear 71 meshes with a pinion 73 (FIGS. 1 and 4) located inwardly of sidewall 1 at one end of a shaft (not shown) rotatably journalled on the sidewall 1 and extending thereacross, the other end of the said shaft having a further pinion 75 secured thereto, this pinion 75 being in mesh with the gear 77 previously mentioned as removably secured to the end of the shaft 67 for driving the first and second tracer assemblies. This gear 77 is itself in mesh with and drives gear 76 (FIG. 4) of the support roll 37.

Figure 4:
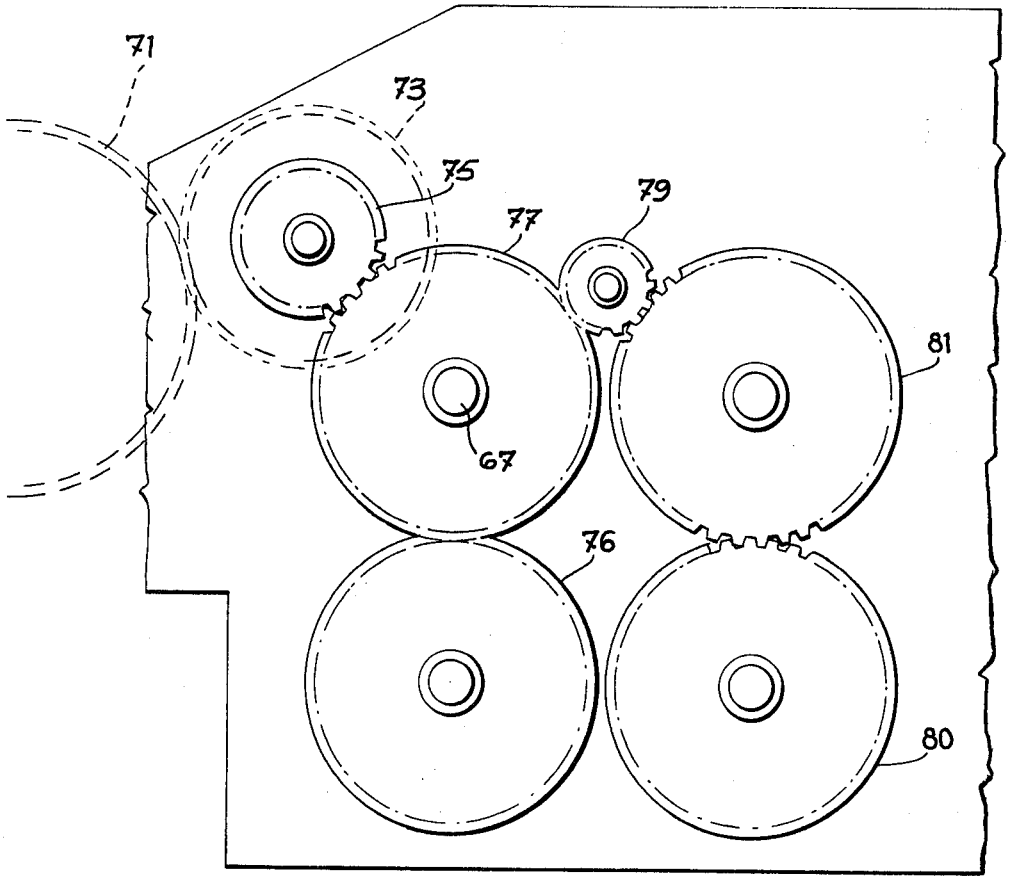
FIG. 4 is a diagrammatic side elevation of the major components of the driving and synchronizing means of the printing press.

Finally, the gears 80 and 81 (FIGS. 1 and 4) of the shafts 49 and 45 of the numbering machine 41 intermesh and receive their rotary motion through a pinion 79 interconnecting the gears 81 and 77 as shown in FIG. 4.

With the aforesaid arrangement and as is known, whenever a new printed sheet is to be provided with tear-lines at a different location, the machine is manually operated until the location on the new printed sheet where a tear-line is needed reaches the top of the support roll 37 in the vertical plane of the axes of the shaft 67 and roll 37. The gear 77 of the shaft 67 is then removed and the fist assembly 61 rotated until the corresponding tracer line 85 stands above the location where the tracer line is needed. This will of course require that the tracer blade 83 be slightly raised into the housing 89. The driving gear 77 is then placed back into position.

A similar procedure is used to locate the second tracer line assembly 63 in whatever new position it is needed except that in this case, the assembly 63 is freely rotated by loosening the two parts of the collars 103.

It will also be appreciated that, in known manner, the numbering assembly located downstream of the tear-line producing assembly is adjusted in a similar manner.

New disks 23 with differently spaced cut outs 157 will of course be needed where assemblies 61, 63 are differently located.

With reference to the third tracer assembly 65 and FIG. 2, it may be added that assembly 65 can be placed in inactive position by means of a short holding bar 159 provided with an inclined notch 161 applicable about the mandrel 123 and with a second notch 163 that can be applied on the stationary spindle 149. With such a bar 159 of properly selected length, the mandrel 123 may be held away a distance such that the tracer disk 125 will not be applied on the sheet 9.

What is claimed is:

1. A printing press including a printing section delivering printed sheets onto a conveying section at a receiving station of said conveying section, said conveying section incorporating a horizontally movable conveyor provided with means for gripping said printed sheets discharged from said receiving station and moving them away from said receiving station, said printing press being characterized by the provision in combination therewith of means for producing tear-lines on said printed sheets, said means comprising:

a rotary shaft disposed transversely of and above said conveyor, adjacent to and downstream of said receiving station a first tear-line tracer assembly fixedly mounted on said shaft, said first tracer assembly projecting radially from and lengthwise of said shaft and including a first tracer blade having an elongated serrated straight cutting edge extending parallel to the shaft rotation axis, said serrated cutting edge being adapted to produce tear-lines when applied over and across said printed sheet material as said sheet material is moved by said conveyor;

a second tracer assembly adjustably mounted on the rotary shaft, said second tracer assembly projecting radially and comprising a second tracer blade having an elongated straight serrated cutting edge extending parallel to the shaft rotation axis, said serrated cutting edge being adapted to produce tear-lines when applied over and across said printed sheets as said sheets are moved by said conveyor, and means for adjustably mounting said second blade on said shaft to position said second blade at a selected angle with respect to the blade of said first tear-line tracer assembly, a rotary support roll beneath said conveyor and over the top of which said printed sheets bear as they are moved by said conveyor, the axes of rotation of said shaft and of said support roll lying in a common vertical plane;

means in said first and second tear-line assemblies to adjust the cutting edges of their respective blades, when lying in said vertical plane, with respect to the top of said support roll to ensure production of said tear-lines on said printed sheets when the latter move therebetween, and means for synchronizing the rotation of said rotary shaft and said support roll with the movement of said conveyor to produce said tear-lines on the printed sheets at a selected location thereon, wherein said means adjustably mounting said second tracer assembly on said shaft comprises:

a blade holding plate having a length greater than said second blade to define portions projecting away from the ends of said second blade;

means adjustably clamping said plate and blade together to allow relative displacement of said blade and plate transversely thereof;

two-part clamping collars and means securing said collars on said shaft;

wherein one part of each of said collars has a holding finger projecting away from said rotary shaft when said collars are secured thereto, said holding fingers being constructed to receive said projecting portions of said blade and means fixing said holding plate to said holding fingers whereby said second blade, through said holding plate and collars, may be positioned on said shaft at said selected angle.

2. A printing press as claimed in claim 1, wherein said first tracer assembly comprises a blade holder formed with an outwardly open U-shaped housing into which said tracer blade is slidably received and means releasably clamping said blade in fixed position into said housing, said housing and clamping means thereby defining said adjusting means.

3. A printing press as claimed in claim 2, wherein said cutting blade has an elongated body having opposed faces and said clamping means comprise a plurality of screws extending through one leg of said housing to apply pressure on one of said opposed faces to press the other of said opposed faces against the other leg of said housing.

4. A printing press as claimed in claim 1, having a press roll in said printing section adjacent said receiving station, said press roll directing said printed sheets toward said receiving station and being rotatable about an axis parallel to the axes of rotation of said shaft and support roll, and wherein said means for producing tear-lines include a third tracer assembly suitable to produce tear-lines extending longitudinally of said printed sheets, said third tracer assembly comprising:

a mandrel mounted parallel to the surface of said press roll and adjacent thereto;

at least one circular rotary tracer disk and means mounting said tracer disk radially and at a selected location on said mandrel, said tracer disk having a circular serrated cutting edge adapted to produce tear-lines when applied over said printed sheets, and means biassing said mandrel towards said press roll to apply said tracer disk against printed sheets being directed toward said receiving station by said press roll.

5. A printing press as claimed in claim 4, wherein said biassing means comprises:

a pair of bell-crank levers and means mounting said levers, at the apices thereof, for pivotal movement thereof about a common axis parallel to the axis of said mandrel;

means mounting the ends of said mandrel to the ends of one arm of said levers for free rotation of said mandrel, and means applying an adjustable bias to the ends of the other arm of said levers to press said tracer disk against said printed sheets.

6. A printing press as claimed in claim 5, wherein said adjustable bias applying means comprise:

a fixed spindle extending parallel to said mandrel and away from said bell-crank levers with respect to said mandrel;

a pair of threaded rods mounted for free rotation about the axis thereof on said spindle and extending radially therefrom in the direction of said mandrel;

control nuts, each screwed onto one of said rods, each of said nut having a finger projecting therefrom laterally with respect to the respective rod, and coil springs, each having one end fixed to the free end of one of said fingers and the other end to the end of the said other arm of one of said bell-cranks.

7. A printing press as claimed in claim 6, wherein said third tracer assembly includes a pair of rotary shafety support rollers each mounted at one end of said mandrel, said rollers bearing on said press roll and having a diameter sufficient to prevent damage to the surface of said press roll by said tracer disk subsequent to an excessive bias being applied to said tracer disk by said biassing means.

8. A printing press including a printing section delivering printed sheets onto a conveying section at a receiving station of said conveying section, said conveying section incorporating a horizontally movable conveyor provided with means for gripping said printed sheets discharged from said receiving station and moving them away from said receiving station said printing section including a press roll adjacent said receiving station for directing said printed sheets toward said receiving station, said press roll being rotatable about an axis parallel to the axes of rotation of said shaft and support roll, said printing press being characterized by the provision in combination therewith of means for producing tear-lines on said printed sheets, said means comprising:

a rotary shaft disposed transversely of and above said conveyor, adjacent to and downstream of said receiving station, a first tear-line tracer assembly mounted on said shaft, said first tracer assembly projecting radially from and lengthwise of said shaft and including a first tracer blade having an elongated serrated straight cutting edge extending parallel to the shaft rotation axis, said serrated cutting edge being adapted to produce tear-lines when applied over and across said printed sheet material as said sheet material is moved by said conveyor;

a rotary support roll beneath said conveyor and over the top of which said printed sheets bear as they are moved by said conveyor, the axes of rotation of said shaft and of said support roll lying in a common vertical plane;

means in said first tear-line assembly to adjust said cutting edge of said blade, when lying in said vertical plane, with respect to the top of said support roll to ensure production of said tear-lines on said printed sheets when the latter move therebetween, means for synchronizing the rotation of said rotary shaft and said support roll with the movement of said conveyor to produce said tear-lines on the printed sheets at a selected location thereon, said means for producing tear-lines on said printed sheets further comprising a second tracer assembly suitable to produce tear-lines extending longitudinally of said printed sheets, said second tracer assembly comprising:

a mandrel mounted parallel to the surface of said press roll and adjacent thereto;

at least one circular rotary tracer disk and means mounting said tracer disk radially and at a selected location on said mandrel, said tracer disk having a circular serrated cutting edge adapted to produce tear-lines when applied over said printed sheets, and means biassing said mandrel towards said press roll to apply said tracer disk against printed sheets being directed toward said receiving station by said press roll, wherein said biassing means comprises:

a pair of bell-crank levers and means mounting said levers, at the apices thereof, for pivotal movement thereof about a common axis parallel to the axis of said mandrel;

means mounting the ends of said mandrel to the ends of one arm of said levers for free rotation of said mandrel, and means applying an adjustable bias to the ends of the other arm of said levers to press said tracer disk against said printed sheets.

9. A printing press as claimed in claim 8, wherein said adjustable bias applying means comprise:

a fixed spindle extending parallel to said mandrel and away from said bell-crank levers with respect to said mandrel;

a pair of threaded rods mounted for free rotation about the axis thereof on said spindle and extending radially therefrom in the direction of said mandrel;

control nuts, each screwed onto one of said rods, each of said nut having a finger projecting therefrom laterally with respect to the respective rod, and coil springs, each having one end fixed to the free end of one of said fingers and the other end to the end of the said other arm of one of said bell-cranks.

10. A printing press as claimed in claim 9, wherein said third tracer assembly includes a pair of rotary safety support rollers each mounted at one end of said mandrel, said rollers bearing on said press roll and having a diameter sufficient to prevent damage to the surface of said press roll by said tracer disk subsequent to an excessive bias being applied to said tracer disk by said biassing means.

11. A printing press as claimed in claim 8, wherein said first tracer assembly comprises a blade holder formed with an outwardly open U-shaped housing into which said tracer blade is slidably received and means releasably clamping said blade in fixed position into said housing, said housing and clamping means thereby defining said adjusting means.

12. A printing press as claimed in claim 11, wherein said cutting blade has an elongated body having opposed faces and said clamping means comprise a plurality of screws extending through one leg of said housing to apply pressure on one of said opposed faces to press the other of said opposed faces against the other leg of said housing.

* * * * *